US010751590B1

(12) United States Patent
Wells et al.

(10) Patent No.: US 10,751,590 B1
(45) Date of Patent: Aug. 25, 2020

(54) GRIP ASSEMBLY FOR SPORTS EQUIPMENT

(71) Applicants: Harry Mattthew Wells, Shelter Island, NY (US); Gregg A Tashker, Kennett Square, PA (US)

(72) Inventors: Harry Mattthew Wells, Shelter Island, NY (US); Gregg A Tashker, Kennett Square, PA (US)

(73) Assignee: Harry Matthew Welsl, Shelter Island, NY (US)

( * ) Notice: Subject to any disclaimer, the term of this patent is extended or adjusted under 35 U.S.C. 154(b) by 0 days.

(21) Appl. No.: 16/597,097

(22) Filed: Oct. 9, 2019

Related U.S. Application Data

(62) Division of application No. 16/414,256, filed on May 16, 2019, now Pat. No. 10,525,315.

(51) Int. Cl.

| | |
|---|---|
| ***A63B 53/14*** | (2015.01) |
| ***A63B 60/08*** | (2015.01) |
| ***A63B 60/16*** | (2015.01) |
| *A63B 60/46* | (2015.01) |
| *A63B 60/06* | (2015.01) |

(52) U.S. Cl.
CPC ..... *A63B 60/08* (2015.10); *A63B 60/16* (2015.10); *A63B 53/14* (2013.01); *A63B 60/06* (2015.10); *A63B 2060/464* (2015.10)

(58) Field of Classification Search
CPC ..... A63B 60/08; A63B 53/14; A63B 60/16; A63B 2060/464; A63B 60/06
See application file for complete search history.

(56) References Cited

U.S. PATENT DOCUMENTS

| | | | |
|---|---|---|---|
| 4,138,118 | A | 2/1979 | Budney et al. |
| 4,819,939 | A | 4/1989 | Kobayashi et al. |
| 4,861,034 | A | 8/1989 | Lee et al. |
| 4,972,733 | A | 11/1990 | Olmr et al. |
| 4,991,850 | A | 2/1991 | Wilhlem et al. |
| 5,322,281 | A | 6/1994 | Ganger, Sr. |
| 5,377,541 | A | 1/1995 | Patten |
| 6,227,069 | B1 | 5/2001 | Yamae |
| 6,402,634 | B2 | 6/2002 | Lee et al. |
| 6,656,057 | B2 | 12/2003 | Manual et al. |
| 6,716,034 | B2 | 4/2004 | Casanova, Jr. et al. |
| 7,837,575 | B2 | 11/2010 | Lee et al. |
| 9,007,190 | B2 | 4/2015 | Bosch et al. |
| 9,114,295 | B2 | 8/2015 | Huang et al. |
| 9,453,142 | B2 | 9/2016 | Rolland et al. |
| 9,630,077 | B2 | 4/2017 | Mikura et al. |

(Continued)

OTHER PUBLICATIONS

J.R. Tumbleston et al. Science. vol. 347, Issue 6228 (2015) pp. 1349-1352, Mar. 20, 2015.

*Primary Examiner* — Stephen L Blau
(74) *Attorney, Agent, or Firm* — Laurence T. Pearson

(57) ABSTRACT

A grip assembly for an item of sporting equipment. The grip assembly is built around a core that is an elongated tubular body dimensioned for mounting on a grip mounting portion of the sporting equipment. The tubular body is formed with a three dimensional open structure located between an inner and an outer wall. The outer surface of the outer wall can also be equipped with a sleeve or other cover to facilitate the grip of a user. Sensors and transmission equipment located within the grip structure can be used to transmit data on forces that the grip is being subjected to, to reception equipment located for convenient viewing by a user.

1 Claim, 10 Drawing Sheets

(56) References Cited

U.S. PATENT DOCUMENTS

| | | | |
|---|---|---|---|
| 9,919,191 | B2 | 3/2018 | Inoue et al. |
| 10,130,858 | B2 | 11/2018 | Lamkin et al. |
| 2003/0084756 | A1 | 5/2003 | Schroder et al. |
| 2016/0136492 | A1 | 5/2016 | Mikura et al. |
| 2018/0104561 | A1 | 4/2018 | Kostaj |

GRIP ASSEMBLY FOR SPORTS EQUIPMENT

PRIORITY INFORMATION

This application is a divisional of, and claims priority to, U.S. patent application Ser. No. 16/414,256 filed on May 16, 2019.

FIELD OF THE INVENTION

The present invention relates to sports equipment and, more specifically, to a grip for sports equipment, for example bats, rackets and clubs, and in particular golf clubs. In some embodiments the grip has the ability to make quantitative measurements of specific mechanical or physical properties of the equipment during operation, for example during a swing, while not interfering with the user's natural operational profile.

BACKGROUND OF THE INVENTION

Various data measuring and collecting devices and methods are useful for analyzing a club, racket, bat, or steering wheel (herein generically referred to as "sporting devices or equipment" or "sports equipment") during a swing or other operation. In a similar manner, the effectiveness of an impact of a ball with sporting equipment during a swing can be measured in terms of initial ball launch conditions. These launch conditions are determined principally by the velocity of equipment at impact and the loft and angle of the ball contacting surface relative to the intended trajectory of the ball's flight. Ultimately the swing of the user and the force applied on the grip by the user, determine the launch conditions of a ball. There are two general methods for analyzing the equipment during a swing; visual analysis and quantitative variable analysis.

The method of analyzing a swing using visual analysis typically is conducted by an instructor capable of visually discerning swing variables and suggesting corrections to the swing to provide improvement. However, not every user has ready access to professional instruction or can translate an instructor's feedback into a more efficient swing. An instructor can also not "see" quantitative factors such as force and acceleration.

Quantitative variable analysis employs sensors to directly measure various mechanical or physical properties of the equipment during the swing motion. Sensors, such as force sensors or inertial sensors, typically are attached to the handle or the striking surface of the equipment or can be attached to the hands of the user of the equipment. Data collected from these sensors then may be transferred to a signal processor via wires or radio waves, and can be presented in various graphical formats, including graphical and tabular charts. A drawback associated with the use of existing instrumented golf clubs and other sports equipment is that the sensors and associated wires can be obtrusive to the user when the user attempts to swing the club or racket. The force and acceleration profile obtained is not then representative of the user's profile when using an unencumbered device.

Swing characteristics will also be different between practice conditions, where a player may be relaxed and more thoughtful about a shot, and actual play where other tensions come into play.

An objective of the present invention is to provide an instrumented grip for sports equipment that delivers an enhanced comfort level to the user when grasped in the course of actually playing the sport or in a practice environment. The device therefore provides a means for comparing swing parameters in the idealized setting of a practice, with actual performance while playing the sport.

A further objective is to provide a monitoring, diagnostic, and training device integrated with the grip for sports equipment. The device can be used without any interference with the natural feel and comfort that the equipment would have if the device were not there. In particular it is not necessary for a user to wear special equipment such as instrumented gloves to produce meaningful data from use of the equipment.

A still further objective is to provide a grip that comprises a lightweight open structure for weight and weight distribution control. The open structure of the grip also allows for placement of electronic equipment in the grip.

BRIEF SUMMARY OF THE INVENTION

The present invention is directed to a grip and a grip assembly for an item of sporting equipment, example for a club, racket, hockey stick, bat, or steering wheel.

In one embodiment, the grip assembly comprises an elongated tubular body having a long axis running from a first end to a second end that is distal to the first end.

The tubular body may have a mean volume density (defined herein) of between 5% and 70%, or 10% and 70%, or even 25% and 70%.

The tubular body further comprises;

an inner wall that extends from the first end to the second end along the long axis, said inner wall having an outer surface and an inner surface, said outer surface forming or defining a hollow interior of the tubular body or in some embodiments of the entire grip assembly, said hollow interior having a cross section through which a shaft of the item of sporting equipment can pass. At least a portion of the inner surface of the inner wall faces an open substructure that provides mechanical support to the grip as well as a continuous open space for weight reduction and control and possible placement of electronic equipment;

an open substructure that is located adjacent to the outer surface of said inner wall in a region between the first end and the second end;

an outer wall that extends from the first end to the second end along the long axis and having an inner and outer surface, the outer surface of the outer wall forms an outer surface of the tubular body extending between said first end and said second end, and the inner surface of the outer wall faces the open substructure over at least a portion of the inner surface;

The "first end" if used in this document corresponds to the end that is proximal to the user of the sporting equipment when the grip assembly is installed thereon and the equipment is intended to be held by the user and swung. In one embodiment a cross section perpendicular to the long axis of the tubular body shows that the inner and outer walls are closed to form tubular structures and form a closed structure around the hollow interior.

When installed on a steering wheel the long axis of the tubular body is curved to fit the shape of the wheel to which it is attached. The axis of the tubular body may be curved when it is intended to be attached to a steering wheel.

In a further embodiment the open substructure can be a three dimensional lattice structure. In certain embodiments the open substructure is not an open cell foam.

In various embodiments of the invention the outer wall may be between 1.2 and 2 mm thick at all points on its surface. The inner wall may be of a thickness of between 1.5 and 2 mm. The hollow interior of the inner wall may have a diameter of 12.7 to 15.5 mm. The tubular body may have a percentage mean volume density of between 5% and 70%, or 10% and 70%, or even 25% and 70%.

In still further embodiments the thicknesses of the inner and/or outer walls and the hollow interior may differ from the numbers given in the preceding paragraph. In particular when special strength is required, such as in a tennis racket or golfing iron or wood, the walls may be thicker.

The open substructure is located between the inner wall and the outer wall and adjacent to the inner surfaces of both walls. In a further embodiment the tubular body predominantly comprises a polymeric material. In a still further embodiment the grip assembly further comprises;

(i) one or more sensors for detecting force applied to the grip, acceleration of the grip, acceleration of the club, or all of the foregoing;

(ii) wireless transmitting equipment for wirelessly transmitting data from the one or more sensors to a receiver located externally to the grip assembly; said transmitting equipment having no wires or other excessive protrusions from the outer surface of the outer wall.

The sensors are embedded in the tubular body. The transmitting equipment is mounted either; (I) in a space within the open substructure, (II) on a surface of either the inner or the outer wall or both, (III) in a cavity in a surface of the inner or outer wall or both, (IV) in a cap mounted at the first end of the grip assembly, (V) outside the grip, or (VI) any combination of the forgoing.

One or more of the sensors may have a force concentrator in contact therewith. In certain embodiments the sensors are not strain gauges or load cells.

The transmitting equipment may in one embodiment be located outside the grip, for example on top of the grip in or adjacent to a cap, or on the shaft of a club or racket.

In one embodiment of the grip assembly of the invention, the open substructure in any of the embodiments described above comprises an open lattice that comprises struts, at least some of which are joined to other struts at nodes. The overall effect of the joining of struts at nodes is to form a three dimensional lattice structure.

In one embodiment the three dimensional lattice comprises struts and/or walls formed from a first material having a Durometer Shore A hardness in the range of 30 to 100, or a Durometer Shore D hardness in the range of 50 to 95.

The three dimensional lattice may in another embodiment comprise struts and/or walls formed from a first material having a Durometer Shore A hardness in the range of 30 to 70.

The open lattice can be characterized by lattice parameters. Examples of lattice parameters include, without limitation implied, the material or materials of construction of the lattice and the mechanical properties thereof, lengths and thickness of the struts, the angles at which they contact at nodes, and the overall mean density of the tubular body.

The individual struts may be contacted with nodes at one or both ends or at any point along the length of the strut, the nodes being points in the structure at which struts contact each other.

The open substructure or the open lattice structure may also comprise ribs that are attached to the inner wall or the outer wall or both, and that provide mechanical support to the substructure.

In a further embodiment, the grip assembly further comprises a fabric material formed into a cover or a skin that extends around and covers essentially the entire surface of the tubular body. The fabric material can be a woven, nonwoven, tape, or film structure. Preferably the fabric comprises predominantly a polymeric material. The polymeric material may be elastomeric. For example, the cover or skin may be a rubber sleeve.

The first end of the grip assembly may comprise a cap that covers at least a portion of the entire cross section of the first end of the assembly. The cap may be removable by hand or with simple hand tools, for example a screwdriver or even a coin. The cap may be hollow and contain electronic equipment such as a transmitter or a power source such as a battery.

The one or more sensors may be connected to a wireless transmission system (otherwise known as a "transmitter") that transmits raw data from the sensors to a remote computer, and/or to a mobile device such as a smartphone. The wireless transmission system may be a Bluetooth® system.

The remote computer presents data to the user and may present the raw or processed data to the user using a numerical format or a graphical user interface (GUI) or any other form of pictorial representation to present data in a graphical format.

The invention is further directed in another embodiment to a method of controlling the weight or feel of a grip assembly that is attached to an item of sporting equipment. The grip assembly is as described in any of the embodiments of the invention described herein.

The method for controlling the feel of the grip assembly comprises the steps of adjusting the detailed open or lattice structure and/or the Durometer hardness of the material during manufacture of the tubular body.

The grip assembly is optimized for a particular user of a sporting device by allowing the user to sample a set of devices with a range of grip assembly properties and/or open lattice properties and allowing the user to select the optimum grip assembly on the basis of one or more predetermined criteria.

The predetermined criteria could, for example, be the subjective feel of the grip in the user's hand.

In one embodiment, the method of controlling the feel of a grip assembly comprises the steps of;

(a) providing a grip assembly that comprises a tubular body as described above, the tubular body may have a mean volume density of between 5% and 70% and comprise;

an inner wall that extends from the first end to the second end along the long axis, said inner wall having an outer surface and an inner surface, said outer surface forming a hollow interior of the grip assembly, said hollow interior having a cross section through which a shaft of the item of sporting equipment can pass. An inner surface of the inner wall faces an open lattice substructure that provides mechanical support to the grip as well as a continuous open space for weight reduction and possible placement of electronic equipment;

an open lattice structure that is located in a region between the first end and the second end and adjacent to the inner surface of the inner wall;

an outer wall that extends from the first end to the second end along the long axis having an inner and outer surface relative to the lattice structure, the outer surface of the outer wall forms an outer surface of the tubular body extending between said first end and said second end and the inner surface of the outer wall faces the open lattice structure over at least a portion of the inner surface.

(b) adjusting the feel of the grip assembly by varying the details of the open lattice structure, the Durometer hardness of the first material, the weight, the mean density, or any of the foregoing. Adjusting the detailed lattice structure may include adjusting parameters selected from the group consisting of the material of construction of the open lattice, the distribution of weight density of the open lattice structure, the Shore hardness of the material of construction of the lattice structure, the detail of the structure of the lattice structure, and any combination of the foregoing.

The invention is also directed to a method for optimizing the structure of a grip assembly for a user of a sporting device comprising the steps of;

(i) providing a grip assembly comprising an open lattice structure in which the open lattice structure comprises intersecting struts and nodes at intersections of the struts, (ii) allowing the user to sample in a series of trials in a sports activity of choice a set of grip assemblies with ranges of open lattice structure and lattice material properties; and, (iii) allowing the user to select the optimum grip assembly from among the ranges of grip assembly properties on the basis of one or more predetermined criteria.

The properties of the material of construction of the open lattice structure may be selected from the group consisting of the Shore A hardness of the open lattice structure material of construction, the Shore D properties of the open lattice structure material of construction, the positions of the struts, the positions of the nodes, and any combination of the foregoing.

The predetermined criteria may be selected from the group consisting of the subjective level of comfort felt by the user, the performance attained by the user in the sports activity of choice, the repeatability of the performance attained by the user in the sports activity of choice over the series of trials, and any combination of the foregoing.

DETAILED DESCRIPTION OF THE INVENTION

When an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

All references cited here are hereby incorporated by reference where allowed.

Definitions

An "outer surface" refers to a surface or portion of a surface that faces towards an outside portion of an object. That surface is referred to as an "outer surface". An "inner surface" refers to a surface or portion of a surface that faces towards an inner portion or interior of an object. For example in the tubular body structure of FIG. 2, the inner surfaces of walls 202 and 205 are those facing the interior lattice structure of the overall structure.

Figure 2:
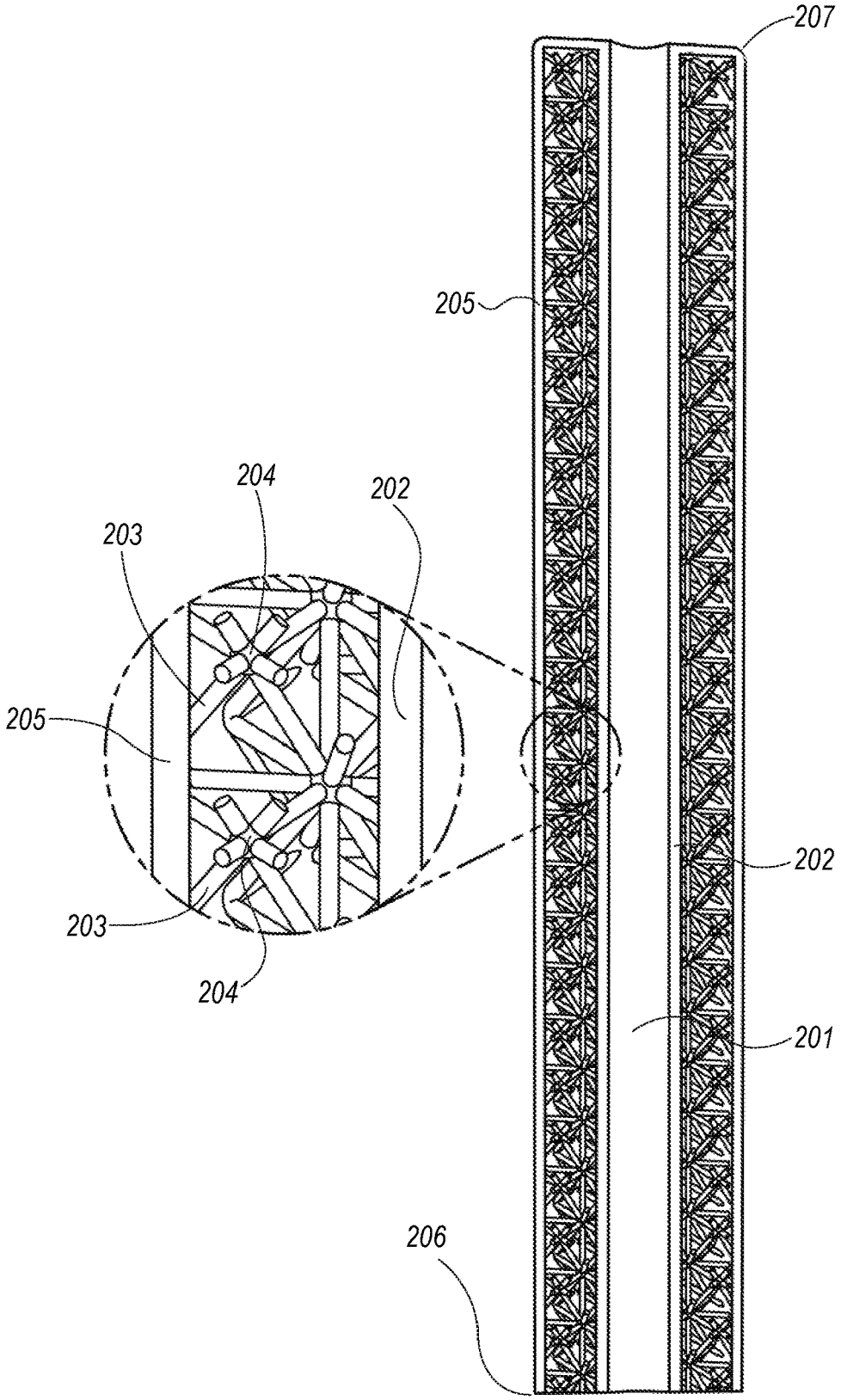
FIG. 2 shows a representation of a length-ways cross section of an embodiment of a lattice structure.
Figure 4:
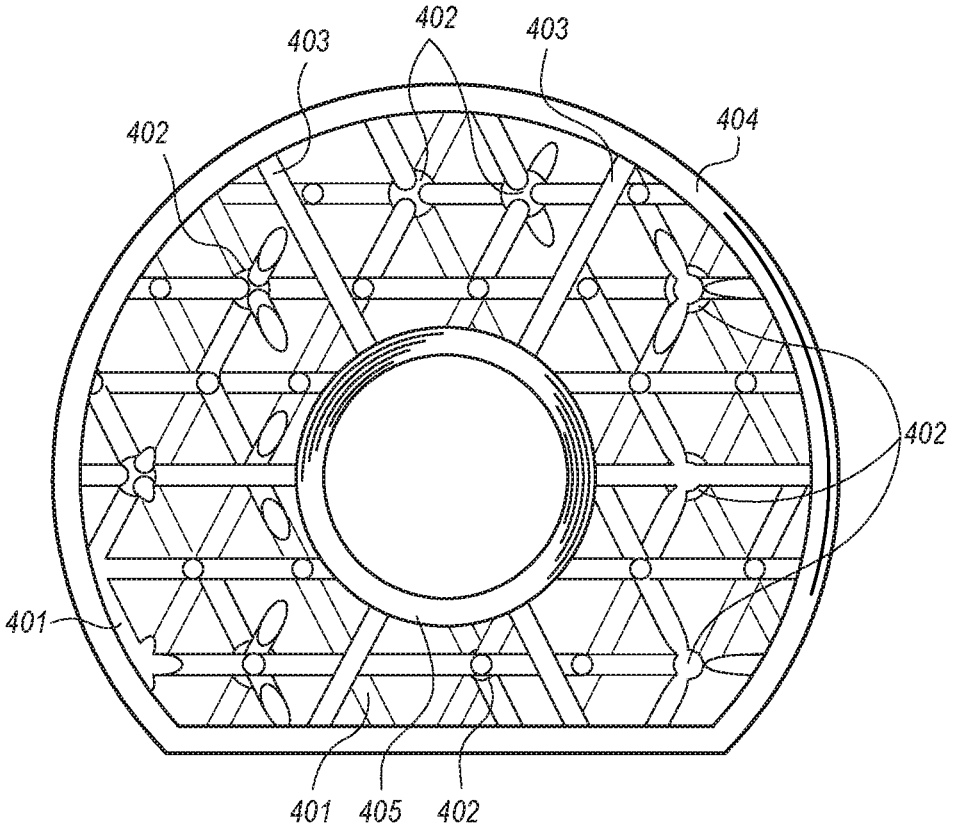
FIG. 4 shows a cross section of an open lattice structure with the first two layers of struts and star shaped rib support structures.

By "tubular body" is meant an elongated structure with an essentially cylindrical cross section at any point and that may be tapered or otherwise contoured on its outside surface. It may also be curved. The tubular body is a tubular structure that may have a first and a second end relative to a long axis (exemplified by 206 and 207 respectively in FIG. 2). The cross section of the tubular body need not be circular and can have any cross section that fulfills the purpose of gripping onto a device to be held by a user and allowing the user to comfortably hold the grip. FIG. 2 shows an example of the cross section of an embodiment of the tubular body of the invention. FIG. 4 shows an example of a cross section perpendicular to the long axis of a tubular body that is not completely circular.

The tubular body may also be curved for use, for example, on a steering wheel. The tubular body may serve as a grip for all or just a portion of a steering wheel. For example the grip containing the tubular body may be employed on a steering wheel at just the portions of the steering wheel where a driver is expected or encouraged to grip the wheel. In a racing car the grip can be placed where the driver grips the wheel.

"Tubular body" refers as described above to a tube comprising an inner wall and an outer wall bounding a three dimensional open substructure. The inner wall has a hollow cross section that is appropriate for receiving whatever shaft, handle, device, or frame that the grip of the invention is to be used on. The tubular body has a percentage "mean volume density" (defined below) of between 5% and 70%, said percentage including the resin volume in the inner and outer walls.

"Open substructure" refers to a portion of the grip located between the first end and the second end, and between the outer wall and the inner wall of an object of the invention. The open substructure comprises a continuous open space and provides mechanical contact between an inner surface of an outer wall and an inner surface of an inner wall of a tubular body. In one embodiment the open substructure comprises struts that are joined by nodes where the struts make contact. In certain embodiments the open substructure is not a foam.

The open substructure can be a lattice structure. By "three dimensional lattice structure" or "open three dimensional lattice structure" or "open lattice structure" or even just "lattice structure" is meant an open substructure comprising an open three-dimensional network of a plurality of substantially linear struts arranged in a pattern in which the struts intermittently unite at nodes and separate, thereby joining at predefined positions to form nodes in various places throughout the length, width and thickness of the structure. The struts thereby form a continuous, three-dimensional network. Each strut may be joined to nodes at one or two of its ends and may be joined to other struts in the middle or any other position of its span. The fact of the struts being linear in this embodiment precludes the structure being a foam in which the majority or even some of the cells have curved or even circular walls.

The struts are sized and arranged relative to each other in order to provide a suitable mechanical response to the force applied by the user of the grip. "Suitable mechanical response" means that the mechanical response to the user's grip provides a level of comfort or performance, for example by cushioning of the user's hand against the grip and/or transmission of the force of the user's swing into the equipment itself. By "predefined positions" is therefore meant that the size, shape, and positions of the struts and nodes is a matter of design that produces the optimum level of comfort and/or performance for the user.

The term "open" in the context of a lattice structure means that the space between the struts and nodes form a continuous path essentially throughout the body of the structure except in locations where solid barriers are deliberately placed for the sake of the design of the structure. An example of a structure that would not be open would be a closed cell foam where essentially all the cells are isolated from each other by solid or liquid barriers.

Figure 1:
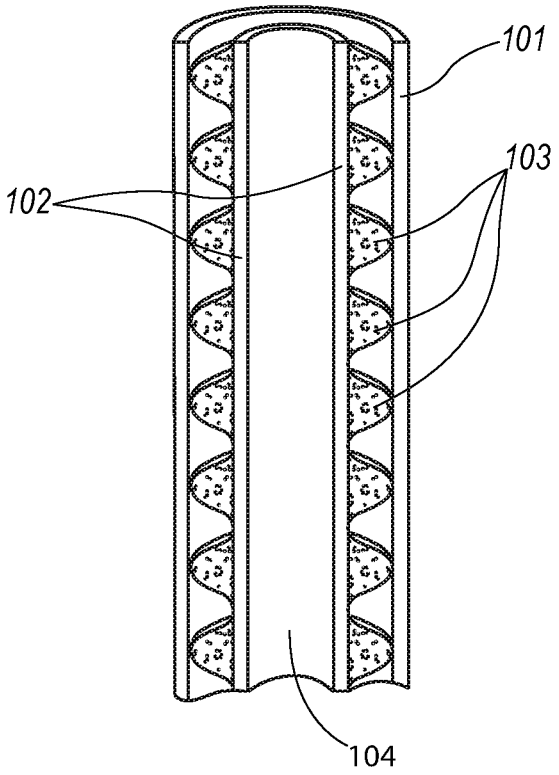
FIG. 1 shows an example of a cross sectional view of an open non lattice structure of the invention.

The term "open" in the context of a non lattice structure means that a continuous air path exists through the structure except in locations where solid barriers are deliberately placed for the sake of the design of the structure. FIG. 1 shows an example of a non lattice open structure.

"Embedded" in the context of a sensor position in the grip in one embodiment means that the item being embedded is located in a cavity or other hollow section or cavity in the tubular body. The item may be placed on a bed in the cavity. Where a sensor is embedded, the sensor may sit with its force sensitive surface either flush with the outer surface of the tubular body or below the level of the surface to an extent that a signal from the sensor is still produced during operation. The "force sensitive surface" can refer to a surface of the sensor or of any force concentrator that is attached to the sensor. In a second embodiment the sensor can be located so that it protrudes from the outer surface of the tubular body to a limited extent only such that the comfort of the user is not disturbed. In a still further embodiment the sensor can sit on the surface of the tubular body but not in a bed or cavity.

By "bed" is meant a structure that can be placed in a cavity to provide mechanical support to whatever is placed in the cavity. For example a piece of transmitting equipment may be supported on a small ligament (a bed) when inserted into a cavity. The bed can be attached to a surface or other component of the cavity.

By "cavity" is meant a hole placed in a portion of the grip assembly in order to make space for, for example, a sensor or sensors, or transmitting equipment. The hole does not need to go through the item in which it sits and can be merely an indentation therein. The item may be fixed directly in the cavity or sit on or against a bed.

The "detail" of the lattice structure refers to the pattern of interconnections between the struts. Such a pattern may be described by parameters such as, without limitation, the lengths of individual struts, the number of struts impinging on each node, the angles at which they impinge upon each other, and the overall density of material within the structure. A lattice is said to have intersecting "struts" when any one strut is connected to one or a plurality of other struts in order to form an interconnected structure.

In FIG. 2, discussed below, is shown an embodiment of a cut-away section of a tubular body that is part of the grip assembly of the invention that shows one non limiting example of the lattice structure. The entire item shown in FIG. 2 can function as one embodiment of the grip assembly of the invention. The grip assembly can further comprise a cover for the tubular body and a cap for the first end.

By "mean density" or "mean volume density" is meant the percentage of solid material volume relative to the total volume of the portion of the tubular body that contains an open lattice structure. The mean density can be measured by measuring the volume fluid displacement in a suitable fluid of the portion of the tubular body if the density of the resin or other material that the body comprises is known. For this calculation the mean density of the tubular body includes the resin that is incorporated into the inner and outer walls.

"Polymeric" refers to a material of construction of any portion of the grip and refers to a polymer of an organic monomer. The polymer can be elastomeric or thermoplastic or a thermoplastic elastomer.

By "excessive protrusions" is meant anything on the surface of the grip that detracts from the user's physical comfort in using the grip or provides a mental distraction for the user's ability to concentrate when using the grip. Examples would be wires, pins, plugs and the like. The word "excessive protrusions" does not apply to the normal dimpling, grooving, or ridging that is applied to a grip to enhance the feel of the grip during use.

By "user's experience" is meant the experience that a user has using the grip in place on an item such as a club, bat, stick, or steering wheel. For example the user's experience includes the physical response of the item to pressure or other force applied by the user, and the mental state applied by the user as measured by the performance such as the effectiveness of the user's swing of a bat or club, or the repeatability of the result of the swing.

"Force concentrator" refers to a device or structure that may be in contact with a force sensor and that distributes the load on the sensor and directs the force that is applied to the sensor to one or more desired locations on the sensor to reduce measurement variability. Examples are the force concentrators (also referred to as "applicator" or "puck") referred to in the "Flexiforce Integration Guide Edition 1" page 15 and published by Tekscan, Boston, Mass. at https://www.tekscan.com/flexiforce-integration-guides. The concentrator typically covers 60-90% of the area of the sensor.

By "grip mounting portion" is meant the portion of the shaft of a piece of sporting equipment such as a club, bat, racket, stick, or steering wheel over which the grip sits. Generally this will be the portion that is inserted into a hollow, inner portion (for example 201 of FIG. 2) of the tubular body in order to secure the grip to the shaft.

By "linear space" is meant a portion of a straight or curved line joining two or more points.

By "along an axis" is synonymous with "following an axis" and means that the item following the specified axis generally tracks the direction of the axis. An axis may be straight, for example the axis of a grip on a golf club, or it may be curved, as will be the case generally for the axis of a grip on a steering wheel.

By a cover "covering essentially all of" a surface is meant that most of the surface is covered and that the hands of the end user of the grip will be in contact with the cover and not the underlying surface.

By "elastic material" is meant a material that recovers to at least 90% of its original dimensions when a force is applied to it and then removed. In the context of the present invention, the magnitude of the force will be those experienced by the sports equipment or devices during use of the grip assembly of the invention.

By "in mechanical contact" of two items is meant that a force applied by an agent to one item is at least partially transmitted to a second item. For example the compressive pressure exerted by a golfer on the outer surface of a golf grip may cause compression of the interior of the grip structure, even though this secondary compressive pressure may be greatly reduced compared to the applied compressive pressure. In another example the force concentrator referred to above would be considered to be in mechanical contact with the sensor.

If one item "predominantly comprises" a second item is meant that a majority of the mass of the first item is composed of the second item.

"Essentially circular" when used to describe a cross section of an item means that the cross section of the item is closed but has variations from circularity, for example with a flat region formed by cutting off a chord from the cross section, or even having an elliptical structure.

By "Durometer material "Shore A" or "Shore D" is meant the hardness of a material as measured using the type A or type D scale respectively in ASTM test method 2240, hereby incorporated in its entirety by reference. Equipment for this test is available, for example, from Rex Gauge Co. (Buffalo, Ill.).

The Durometer A scale is for softer materials, while the D scale is for harder ones. Durometer measures the depth of an indentation in the material created by a given force on a standardized presser foot. This depth is dependent on the hardness of the material, its viscoelastic properties, the shape of the presser foot, and the duration of the test. ASTM D2240 durometers allow for a measurement of the initial hardness, or the indentation hardness after a given period of time. The basic test requires applying the force in a consistent manner, without shock, and measuring the hardness (depth of the indentation). The material under test should be a minimum of 6.4 mm (0.25 inches) thick.

By an end of the assembly "corresponds to" the user end of the club is meant that the end of the assembly is proximal to the user of the club or bat in use. The other end of the assembly is relatively more distal to the user. For example in FIG. 2 the cross section is shown having no particular slight taper formed by a variation in the quantity of material between end 207 and 206. In certain embodiments there could be a taper that narrows between 207 and 206 and in this case end 207 could be referred to as corresponding to the user end of the club.

In all references to a "cap" or "capped end" herein, the cap or capped end may be integrated into the assembly structure or it may comprise a separate cap that is attached in some way, for example to end 207, such as by glue or a threaded portion, to the end of the assembly. The cap may be designed to enclose electronic circuitry and/or an energy source such as a battery.

If the cap is "removable by hand" then the cap can be removed from the first end of the grip assembly by a user's hand, for example by unscrewing or unlatching, or with a light (e.g. plastic) tool with no resort to the use of screwdriver, wrench, or pliers.

By "laminated" is meant that when two essentially two dimensional structures such as sheets or skins are attached to each other by some means by all or just a portion of their two surfaces, then they can be said to be laminated. The attachment means can include gluing or welding with heat or ultrasonic energy but is not limited thereto.

An example of a process for creating the open substructure is the process of 3D printing, in which a solid structure is created in a one step, continuous operation by in situ polymerization of monomer. In this embodiment, the open lattice structure and the inner and outer walls together with any beds or cavities that may contain sensors or wireless transmitting equipment form an integral structure in which these items have not been formed separately and then attached. As an example of a process of this type that is suitable for the manufacture of the tubular body of the present invention, see John R. Tumbleston et al., (*Science,* 347:1349-1352), the contents of which are hereby incorporated by reference in jurisdictions where incorporation is allowed.

By "feel" of the grip assembly is meant the user's experience of the mechanical response to the user's hands on the grip. This experience can be interpreted as comfort in using the grip, and/or also performance such as the effectiveness of the user's swing or the repeatability of the result of the swing.

Embodiments of the Invention

General Description of Grip Assemblies

Grips may generally have an elongated shape and may be slightly tapered on the outside. A grip may be substantially cylindrical and tapered, or may have a pistol-grip, handlebar-grip, or blade-like cross section shape. For example, where the invention provides a putter grip with a housing, the grip can be tubular, tapered, a paddle style (with a flat area for the user's thumbs), or any other style known in the art. A grip may be substantially evenly round or have a reminder (i.e., a line or rib on the grip that reminds the golfer where the hand should be placed). For use on a steering wheel the grip length would be shaped to the contour of the wheel.

A grip may further comprise a sleeve member with a gripping surface. The sleeve member may comprise a fabric material. For example, one end of the sleeve may be open to fit over the shaft of a golf club. The tubular body of the present invention may in some embodiments have a sleeve or wrap covering it. The end distal to the open end may be open, formed into a cap that covers at least a portion of the entire cross section of the first end of the assembly. Generally, the inner wall will form a bore to complement the shaft of the device it fits on, for example a golf club or tennis racket.

Specific Embodiments of the Invention

The invention is directed to a grip assembly, where the grip assembly comprises an open substructure that is internal to the grip and is bounded by two walls as part of a tubular body. FIG. 1 shows an example of an embodiment of a non-lattice type open structure of such a grip that would be suitable for a golf club or tennis racket. Item 101 is the outer wall of the structure and provides a surface onto which the user grips. In one embodiment the outer surface of item 101 is provided with a covering that a user can grip with their hands. Item 102 is the inner wall that bounds the space 104 that takes the inserted club or racket. 103 represents a helical structure extending from one end to the other of the grip. The helix provides a continuous open space that yields comfort to the user, control of the weight of the grip, and space to insert electronics such as sensors and transmission equipment. The pitch of the helix can be adjusted to regulate the overall density of the grip.

In one embodiment, the open structure is an open lattice structure (also referred to herein as simply a "lattice structure" or "three dimensional lattice structure".

The invention is directed in a further embodiment to a grip assembly comprising a tubular body having an axis running from a first end to a second end that is distal to the first end. The axis can be straight or curved. The straight axis would typically be used in equipment that intended to be swung at a ball, for example. The curved axis would be used typically in a steering wheel.

The tubular body, including the material of construction of the inner and outer walls, may comprise a mean volume density of between 5% and 70%, or 10% and 70%, or even 25% and 70%. Referring to FIG. 2 for reference, the tubular body further comprises;

1) an inner wall that extends from the first end to the second end of the tubular body (for example 202 of FIG. 2) for contacting said grip assembly to a shaft of sporting equipment, said wall having an outer surface forming a hollow interior of the assembly, said interior having a cross section through which the shaft of an item of sporting equipment can pass. The inner surface of the inner wall faces an open substructure.
2) An open substructure that is located adjacent to the inner surface of said inner wall in a region between the first end and the second end. The open substructure can comprise an open lattice structure comprising struts (203 of FIG. 2) and nodes (204 of FIG. 2); and
3) An outer wall that extends from the first end to the second end of the tubular body (for example 205 of FIG. 2) having an inner and outer surface, the outer surface of the outer wall forms an outer surface of the tubular body extending between said first end and second end, and the inner surface of the outer wall faces the open substructure over at least a portion of the surface.

The first end corresponds to the tip of the user end of the club, racket, bat, or any other equipment intended to be swung by a user when installed thereon.

FIG. 2 shows a length-ways cut away of an embodiment of the grip assembly of this embodiment. A hole or space 201 running through the assembly is configured to fit an item of sports equipment. For example a golf club shaft. A continuous inner wall (202) separates the space 201 from an open substructure (for example formed by nodes and struts 204 and 203 in FIG. 2). In the example shown here, the substructure is a lattice characterized by the presence of struts (203) and nodes at the intersections of the struts (204). An outer wall (205) provides a gripping surface for the user.

The open substructure, here shown in FIG. 2 as a lattice structure, is located between the inner wall (202) and the outer wall (205) via the inner surfaces of both walls.

The open substructure may in one embodiment predominantly comprise a polymeric material and the grip assembly further may comprise either or both of the following;

(i) one or more sensors for detecting force applied to the grip, acceleration of the grip, or both;
(ii) wireless transmitting equipment for wirelessly transmitting data from the one or more sensors to a receiver located externally to the assembly; said transmitting equipment having no wires or other excessive protrusions from the outer surface of the outer wall.

The sensors are embedded in the tubular body and said transmitting equipment is mounted either; (I) in a space within the open substructure, (II) on a surface of either the inner or the outer wall or both, (III) in a cavity in a surface of the inner or outer wall or both, (IV) in a cap mounted at the first end of the grip assembly, (V) outside the grip, or (VI) any combination of the forgoing.

The transmitting equipment or some elements of it may be mounted on the first end of the grip in a way that does not produce any excessive protrusions from the grip or in the vicinity of the grip that may interfere with a user's experience of using the item of sporting equipment.

In a further embodiment, the grip assembly further comprises a fabric material formed into a cover or sleeve that extends around essentially all of the outer wall and covers essentially the entire outer surface of the outer wall.

In a still further embodiment of the invention the grip comprises an open lattice structure formed from polyurethane polymer, polyurethane acrylic or combination of the two. The open lattice structure may be formed from a thermoplastic polyurethane.

In a still further embodiment the open lattice structure is made and manufactured by the process of 3D printing.

Turning now to the figures, in FIG. 2 is shown an example of a cut-away section of an embodiment of the open substructures that are useful as part of the grip assembly of the invention.

FIG. 2, as described above, shows a length-ways cut away of an embodiment of a tubular body with an open lattice structure. Hole or space 201 running through the whole or part of the assembly is configured to fit an item of sports equipment or a steering wheel. For example a golf club shaft. An inner wall (202) separates the space 201 from an open substructure, shown in FIG. 2 as a lattice structure. In the example shown here, the substructure is a lattice characterized by the presence of struts (203) and nodes joining the struts (204). An outer layer (205) provides a gripping surface for the user, or a surface onto which a fabric layer or cover or sleeve may be applied. Items 206 and 207 denote the two ends of the structure.

Figure 3A:
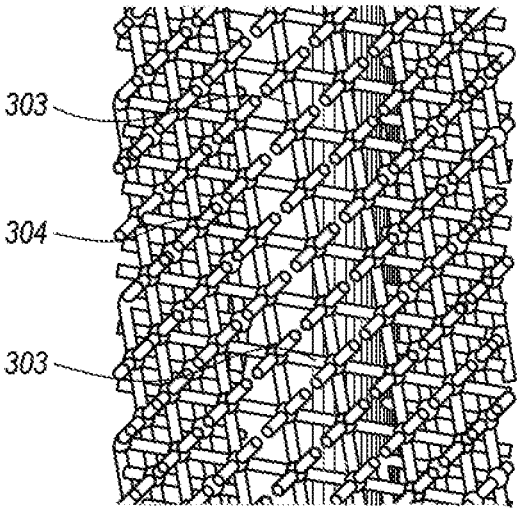
FIGS. 3 A and B show a side representation of a lattice structure and a perspective representation of the same lattice structure.
Figure 3B:
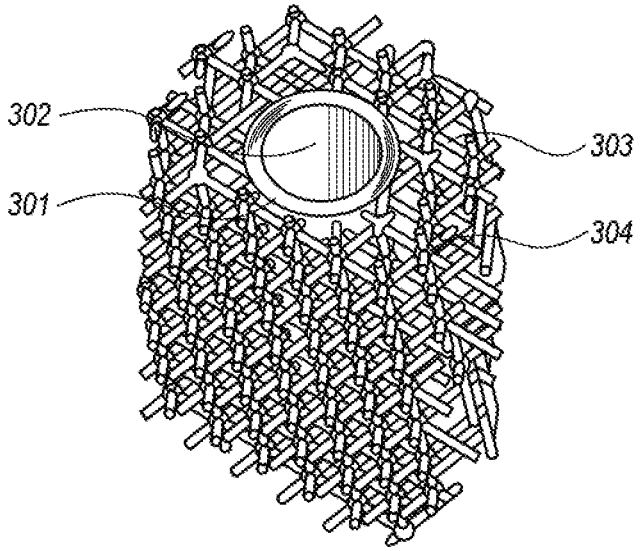

FIG. 3A shows a side view of one further non-limiting example of a lattice structure that is useful in one embodiment of the invention. The lattice structure shown in FIG. 3A does not show the outer wall, or the exact outline of the inner wall due to obstruction of the view of the edge of the wall by struts and nodes, however vertical shading is shown where the inner wall appears in the view. FIG. 3B shows a perspective view of the same structure. The outer wall that is a part of the tubular body is not shown in these figures. The structure has an inner space (302) and an inner wall (301) that is a part of the tubular body and surrounds a shaft or handle of the sports equipment to which the assembly is attached, for example the shaft of a golf club. The inner wall may be a continuous, closed structure, or it may have an open structure.

The three dimensional lattice structure of, for example, FIGS. 3A and 3B comprises struts (exemplified by item 303 in the figure) that are joined together at nodes (exemplified by 304 in the figures) to form a continuous open structure. Beds, cavities, or recesses (not shown) may be incorporated into the structure for holding sensors or wireless transmitting equipment.

Further embodiments of the invention may comprise different strut positions and spacings and also overall densities or open volumes. The lattice structures may have internal support ribs. For example in FIG. 4 is shown a cross section of cut through a tubular body perpendicular to the long axis of the body. The cross section shows the top layers of struts and nodes. An open substructure is shown showing struts (exemplified by 401) joined by nodes (402) and a support structure comprising support ribs in a star configuration (403) passing down the length of the substructure and connecting the inner wall (405) and an outer wall (404). The embodiment of FIG. 4 shows an outer wall (404) that is a part of the structure.

Figure 5A:
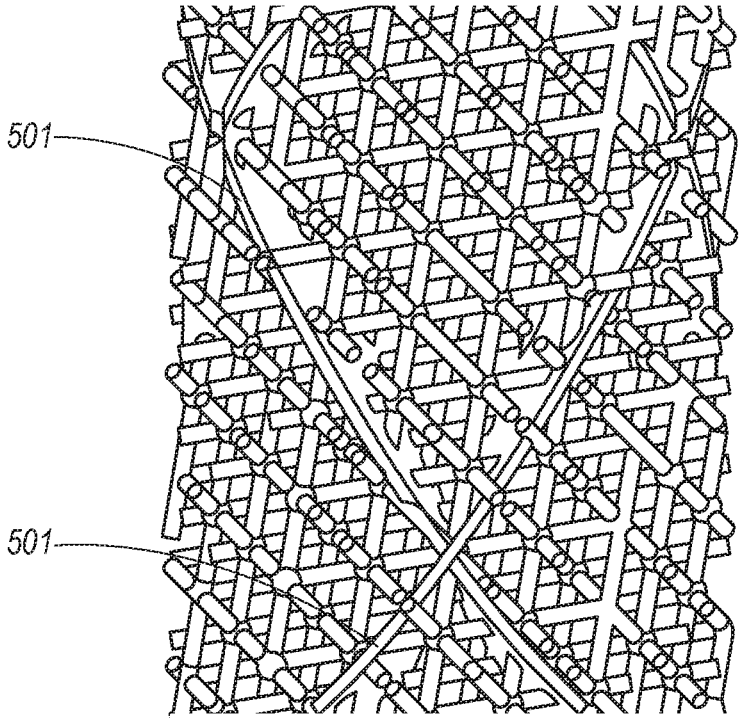
FIGS. 5 A and 5 B show examples of open structures with tri-helix support ribs or inclined square ribs.
Figure 5B:
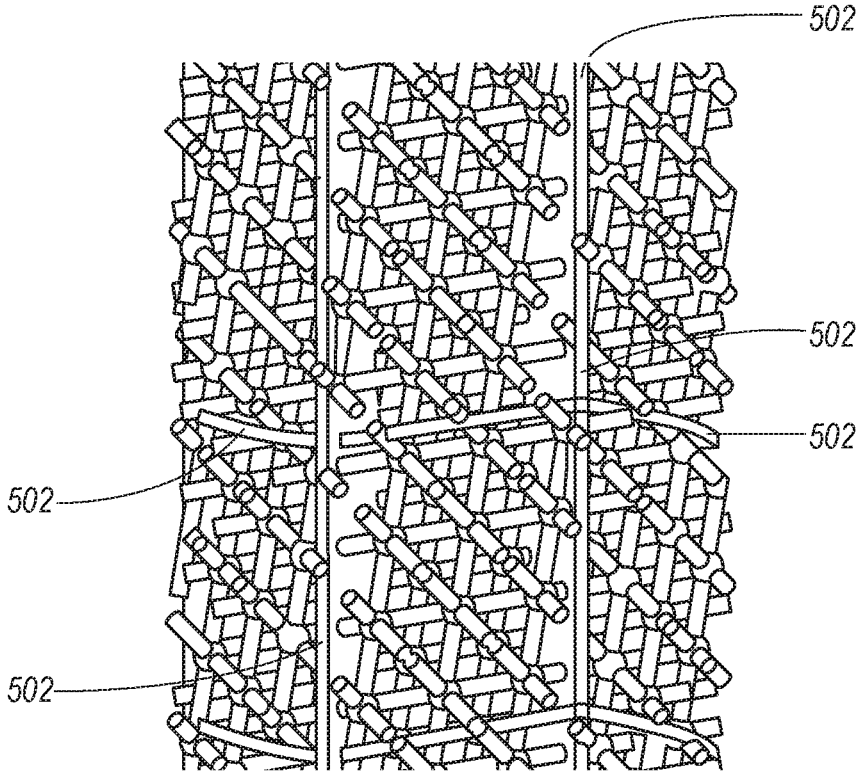

FIGS. 5A and 5B show different examples of side views of support rib structures in different embodiments of the invention. These figures show only the open substructures. Inner and Outer walls are not shown. FIG. 5A shows a tri-helix structure (501). FIG. 5B shows an inclined square support rib structure (502). Any of the rib structures suitable for inclusion in the invention may be perforated with any perforation pattern.

Similarly any of the inner or outer wall structures suitable for inclusion in the invention may be perforated with any perforation pattern.

Examples of the material of formation of the object can be found in U.S. Pat. No. 9,453,142 to assigned to Carbon3D and incorporated herein by reference where allowed. The '142 patent describes polymerizable liquids useful for the production of a three-dimensional object comprised of polyurethane, polyurea, or a copolymer thereof.

A polymeric, elastic, material of formation for the tubular body may comprise a polyurethane polymer or copolymers or blend thereof, an acrylic polymer, a silicone rubber, an epoxy resin, or any mixture or copolymer of the preceding. The first polymeric, elastic, material may have a Durometer Shore A hardness in the range of 30 to 100 or a Durometer Shore D hardness in the range of 50 to 95.

A material of formation for the cover or sleeve of the outer wall may also be formed of an elastic material. In certain embodiments the cover or sleeve material comprises a polyurethane polymer or copolymers or blend thereof, an acrylic polymer, a silicone rubber, an epoxy resin, or any mixture or copolymer of the preceding. The cover may be bonded or laminated by any other mechanism known to one of skill in the art to said outer surface of the outer wall.

The outer cover may also be sufficiently thin for the hands of a person gripping the item of sporting equipment to be in mechanical contact with the tubular body and the sensors incorporated therein.

In a still further embodiment one or more sensors for detecting force applied to the grip, acceleration of the grip, or both, are mounted in one or more beds, cavities, or recesses. The sensor beds or recesses can be integrally and seamlessly mounted within the open lattice structure, on the surface of the open lattice structure adjacent to the first material covering, in a cavity in the lattice structure or outer wall, or any combination of the forgoing.

The one or more sensors may be connected to a wireless transmission system that transmits data from the sensors to a remote computer or portable device such as a smart phone for providing an indication of the magnitude of the forces on the grip.

Examples of thin film sensors that are suitable for placement in the present invention are those manufactured by Tekscan Inc. (Boston, Mass.) under the name "Flexiforce" and described in the article "Measurement and analysis of grip force during a golf shot." (E. R. Komi et al., Proc IMechE, 222, 23-35), hereby incorporated by reference in its entirety where allowed. In one embodiment, the grip assembly does not incorporate strain gauges as sensors.

The invention is also directed to a method of controlling the feel of a grip assembly comprising the steps of;

(a) providing a grip assembly for an item of sporting equipment, said grip assembly comprising an elongated tubular body having a long axis running from a first end to a second end that is distal to the first end, said tubular body comprising;

an inner wall, said inner wall having an outer surface and an inner surface, said outer surface forming a hollow interior of the grip assembly, said hollow interior having a cross section through which a shaft of the item of sporting equipment can pass. An inner surface of the inner wall faces an open lattice substructure that provides mechanical support to the grip as well as a continuous open space for weight reduction and possible placement of electronic equipment;

an open lattice structure that is located in a region between the first end and the second end and adjacent to the inner surface of the inner wall;

an outer wall having an inner and outer surface, the outer surface of the outer wall forms an outer surface of the tubular body extending between said first end and said second end and the inner surface of the outer wall faces the open lattice structure over at least a portion of the inner surface;

wherein the open lattice structure is located between the inner wall and the outer wall.

(b) adjusting the structure of the open lattice structure by adjusting parameters selected from the group consisting of the material of construction of the open lattice structure, the Shore hardness of the material of construction of the open lattice structure, the detail of the structure of the open lattice structure, and any combination of the foregoing.

In an embodiment of the method of the invention, the method further comprises the steps of providing a person that is a potential end user of the grip assembly with a selection of items of the same kind of sporting equipment, each device having a grip assembly of the invention of any of the claims attached thereto. Each grip assembly differs from all the other grip assemblies in terms of the detail of the construction of the open substructure. The potential end user then decides which is their optimum grip based on one or more criteria.

For example, in one embodiment the invention is directed to a method for optimizing the structure of a grip assembly for a user of a sporting device comprising the steps of;

(a) providing a grip assembly of any of the embodiments described above that can be defined by a range or properties, said grip assembly comprises a tubular body that comprises an open lattice structure that can be defined by a range of properties (b) allowing the user to sample in a series of trials in a sports activity of choice a set of grip assemblies with ranges of open lattice structure and lattice material of construction properties; and, (c) allowing the user to select the optimum grip assembly from among the range of open lattice structure properties on the basis of one or more predetermined criteria.

The open lattice structure properties in the method may include the Shore A hardness, the Shore D properties of the first material, the positions of the struts and/or nodes, or any combination of the foregoing.

The predetermined criteria in the method may include the subjective level of comfort felt by the user, the performance attained by the user in the sports activity of choice, the repeatability of the performance attained by the user in the sports activity of choice over the series of trials, or any combination of the foregoing. For example if the performance of a golf club is being optimized, then performance and repeatability can be assessed as described in the "examples" herein, where the location of a ball after a shot can be measured with some kind of reference location.

Examples

Manufacture of Lattice Structures by 3D Printing

Open lattice structures suitable for use in embodiments of the invention can be configured as lattices as described above.

In a first example of a lattice structure suitable for use in the invention, lattice structures of a size suitable for use in the grip assembly of the invention were manufactured by a 3D printing process. (HP JET Fusion 3d Printer, Hewlett Packard, Palo Alto Calif.). The material of construction was polyamide (PA) 12. (Formlabs, Somerville, Mass.; Flexible FLFLGR02, Hardness 80-85 Shore A post cured.)

In a second example of a lattice structure suitable for use in the invention, lattice structures of a scaled down size relative to those of the first example were manufactured by a second 3D printing process. (Formlabs, Somerville, Mass.) The material of construction was thermoplastic polyurethane (EnvisionTech, Dearborn, Mich.; Urethane Acrylic Material, Hardness 56 Shore A and 100 Shore A)

Incorporation of Sensors and Electronics into a Grip Assembly

In order to demonstrate the feasibility of obtaining data remotely from sensors that are entirely incorporated into the grip assembly with no hard wired connections to an external receiver, five grips had sensors and electronics incorporated into them. Grip A was a standard putter grips and grip B, C D, E were Superstroke models Flatso 5.0, Flatso 1.0, Flatso 3.0, Slim 3.0 respectively.

The grips were attached to golf putters; Ghost Spyder Putter, (TaylorMade, Carlsbad, Calif.), White Hot Putter #2, (Odyssey, Calloway Golf, Carlsbad, Calif.), Isopur 2 (Ping, Phoenix, Ariz.). The instrumented putters were tested over controlled putting distances of 10, 20, and 30 feet by novice, avid and expert golfers, as defined by the golfers' handicaps or lack thereof.

Shaft diameters for the clubs are shown in table 1 below.

TABLE 1

| Shaft Diameters (millimeters) | | | |
|---|---|---|---|
| | Top* | Below Grip | 100 mm below grip |
| Odyssey White Hot #2 Putter | 14.7 | 14.1 | 12.5 |
| Ping Isospur 2 | 14.7 | 12.7 | 11.2 |
| Taylor Made Ghost Spyder | 14.7 | 14.0 | 11.8 |

*The shaft diameter at the top was not directly measurable due to the presence of a cap. The numbers given here are taken in the proximity of the top.

Force sensors model Flexiforce A 502 were obtained from Tekscan (Boston, Mass.). Transmission of data from the sensors to a (PC) was via a Wi-Fi link, via a wireless router used in Ad Hoc mode. Two sensors were used one for the right hand and one for the left hand. Data sampling frequency was set between 20 and 200 Hz.

Sensors were taped completely covered onto the surfaces of the grips. A transceiver was attached with Velcro straps onto the shaft of the club. From this configuration it was possible to measure the compressive force that was applied to the grip by the right and left hands of a golfer during a swing of the putter. The effect of a covering skin over the grip and that covered the sensors could also be evaluated.

Results

Figure 6:
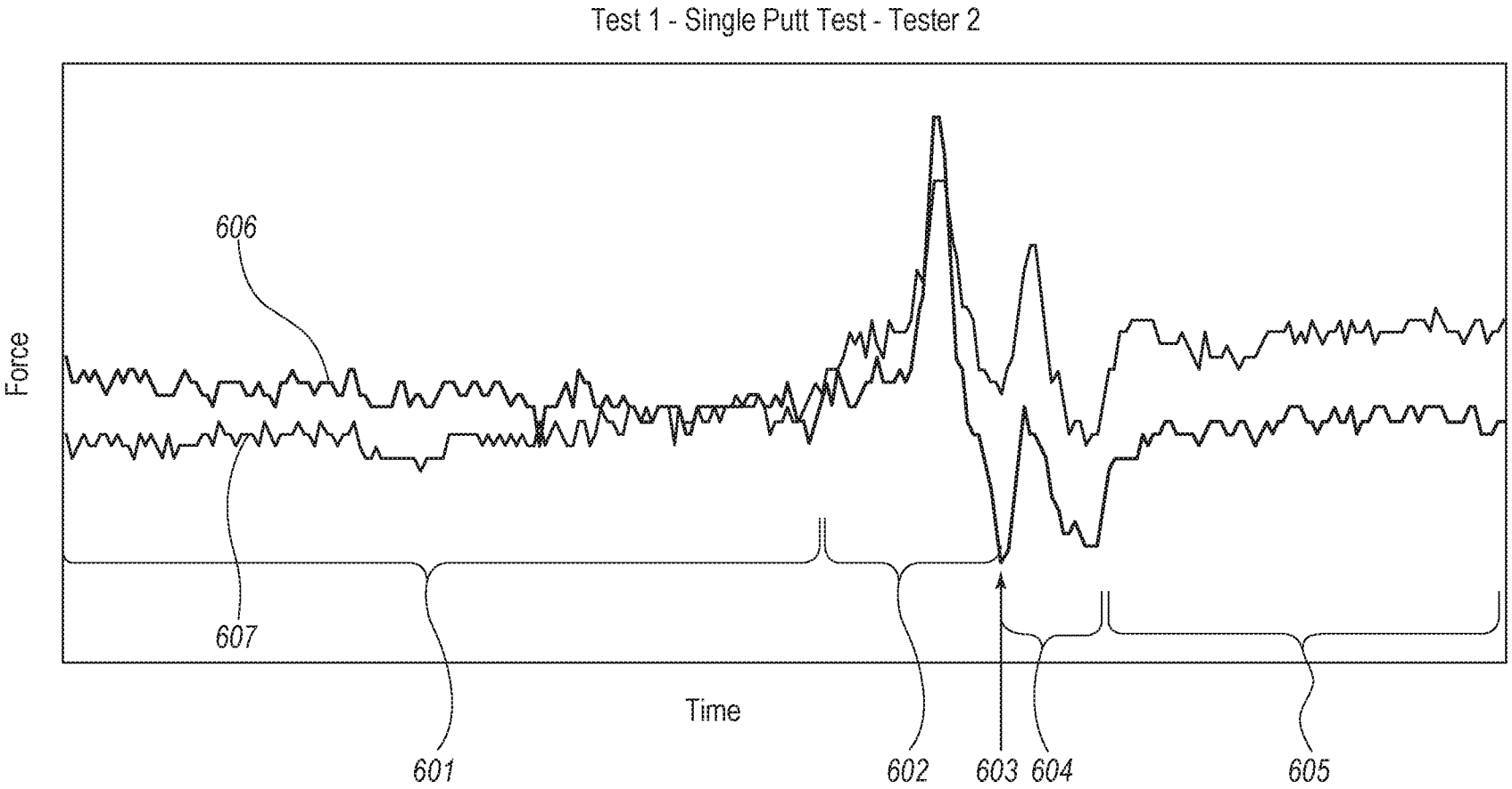
FIG. 6 shows an example of the force curves obtained from stress sensors attached to a grip.

FIG. 6 shows an example of the force curve that was obtained from a typical test with tester 2, an experienced player with a handicap of 25 who golfs several times a week. Curves 606 and 607 represent typical force vs. time curves that appear from the sensors under the left and right hands respectively.

The regions are shown using curly brackets on the figure, with lead lines from the numbers pointing to the brackets. The region 601 shows the resting state of the golfer and also indicates changes that may be taking place in the grip when the golfer is preparing mentally for the shot. The backswing is shown in region 602. For this particular trial the force applied to the grip is approximately the same for both hands. At point 603 the golfer makes a transition between the backswing and the forward swing.

Region 604 shows the remainder of the forward swing. The difference between the forces applied by either hand is shown here. Region 605 then shows the new resting state of the golfer. The differences between the resting state after the swing (region 605) and before the swing (Region 601) can also be seen.

Parameters that can be extracted from the force curve include without limitation;

i. Resting force and variability from region 601.
ii. Resting time until backswing in region 601.
iii. Forces applied during backswing from both hands from region 602.
iv. Time to transition from backswing to forward swing, regions 602 to 603.
v. Forces applied by both hands during forward swing region 604.
vi. Forces applied by both hands at ball contact.
vii. Forces applied and variability in both hands at resting state after the swing region 605.

Both forces and the variability of the forces over different trials can be measured from several swing attempts.

Further ways of analyzing force data from grips can be found in U.S. Pat. No. 4,138,118 to Lamkin and hereby incorporated by reference.

Figure 7:
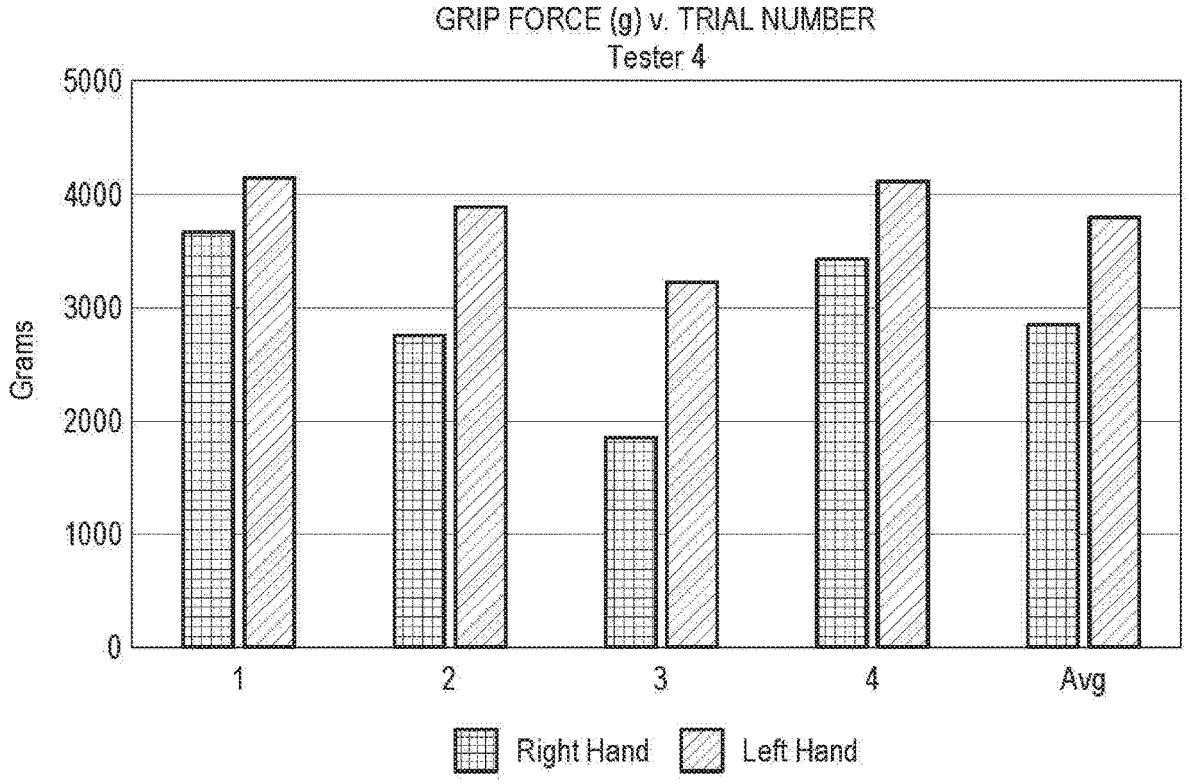
FIG. 7 shows a comparison of maximum force for each hand for a first tester during a putt.
Figure 8:
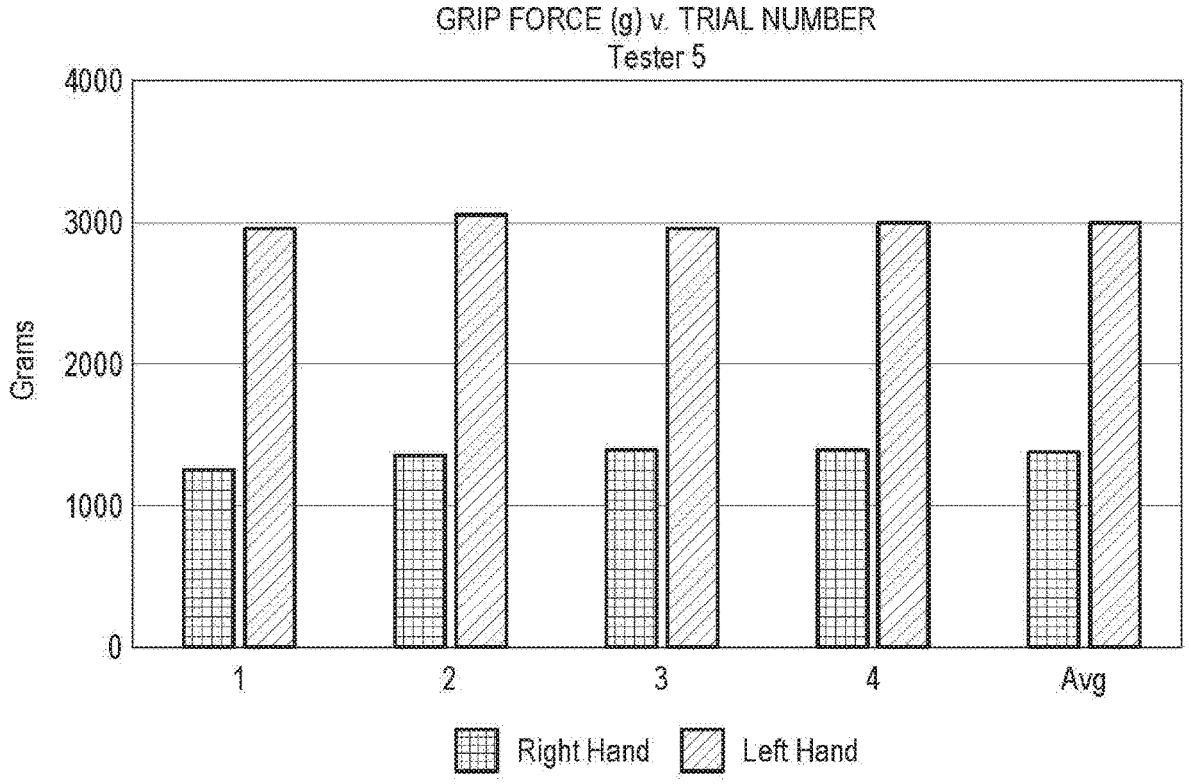
FIG. 8 shows a comparison of maximum force for each hand for a second tester during a putt.

FIGS. 7 and 8 show the difference between the forces applied by each hand by a novice golfer (tester 4) and an avid golfer (tester 5) respectively over 4 trials. Bars on each chart show the forces applied to the grip by the right and left hand. The avid golfer's chart FIG. 8 is characterized by very little variation in applied force for either hand, and significantly more force applied with the left hand than the right.

The novice golfer in FIG. 7 shows high variability in both right and left hands. Although the force applied by the left hand is higher than the right for each trial, the difference between the two hands is less than it is for the avid golfer. The results suggest that the novice golfer could improve their game in this regard by working towards the consistency of the avid golfer and focusing on the difference in applied forces between the two hands.

Figure 9:
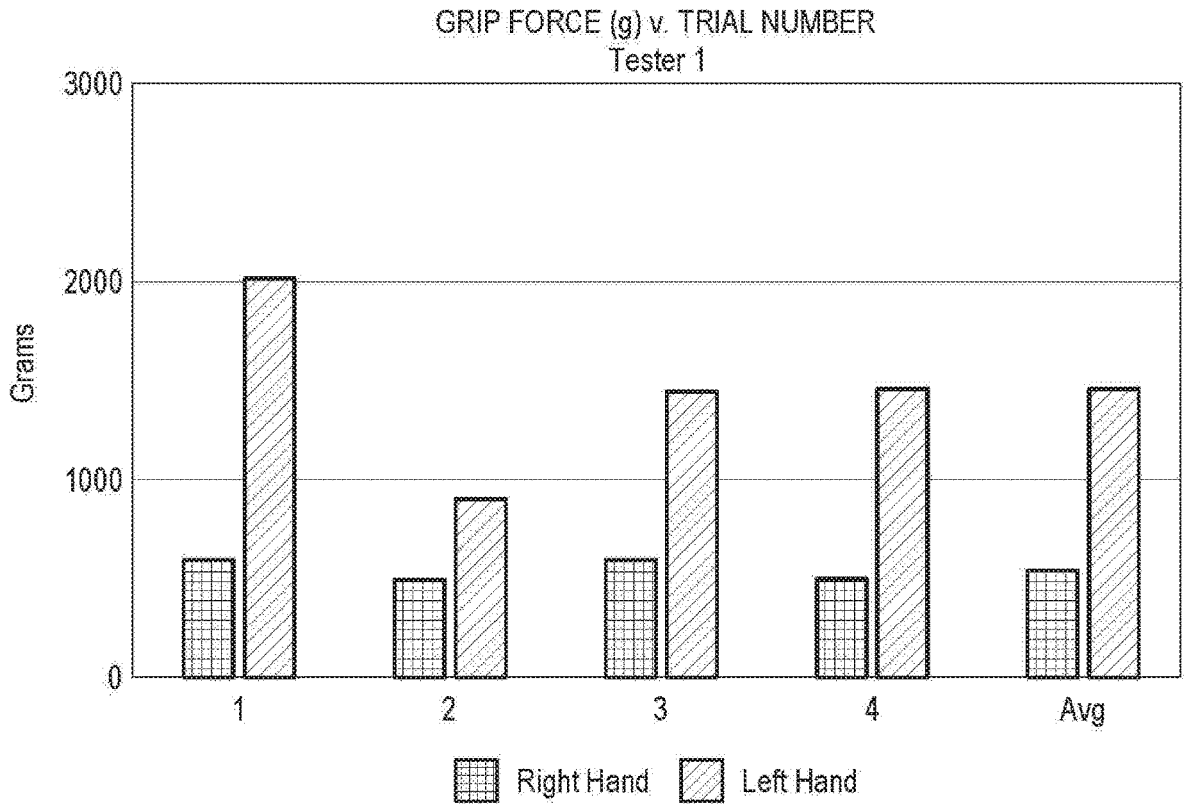
FIG. 9 shows the maximum force applied for right and left hands during a putt for a third tester.
Figure 10:
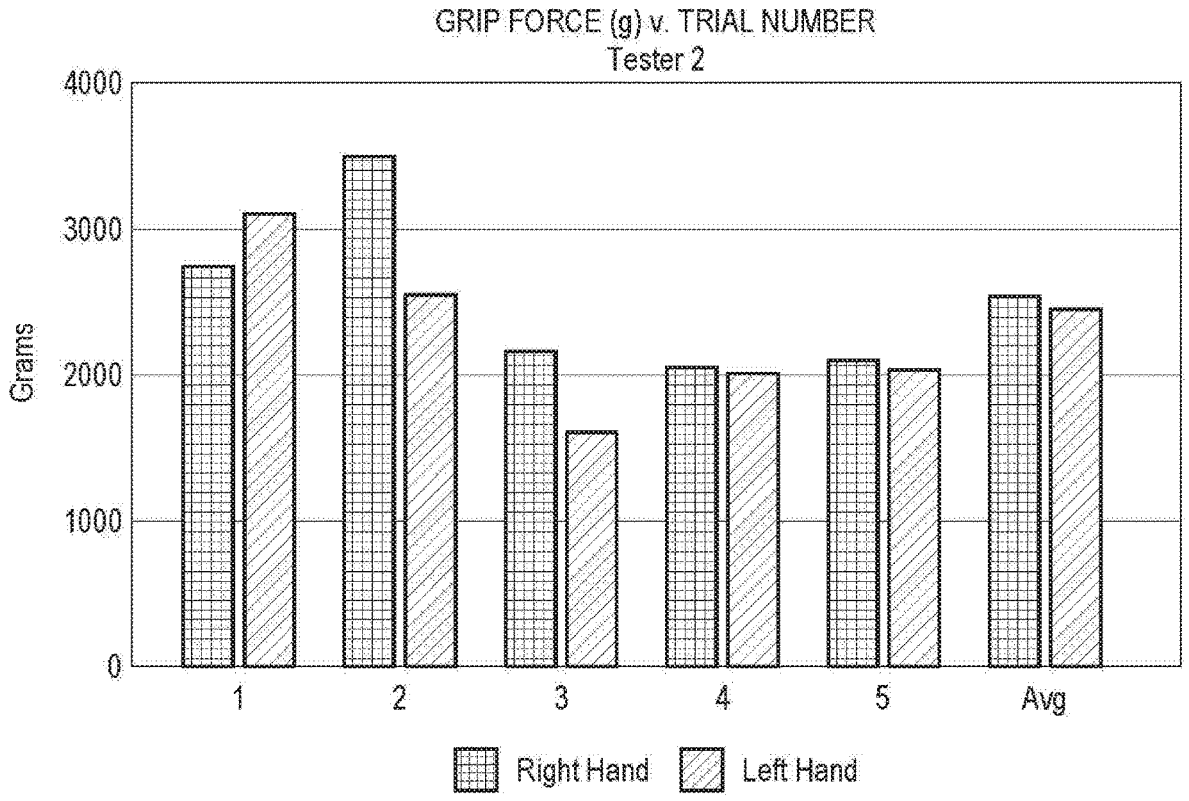
FIG. 10 shows the maximum force applied for right and left hands during a putt for a fourth tester.

FIGS. 9 and 10 compare maximum force exerted by a second avid golfer (tester 1) compared to a second novice golfer (tester 2) over series of trials. The avid golfer shows more consistency from trial to trial and is applying less force to the grip than the novice.

The data shown here are examples of the utility of the present invention in sports instruction. The embodiments described herein and the experiments that are described above are not to be considered in any way limiting on the scope of the claims which follow.

Example 2. Open Lattice Structure Testing

Grip Construction

Star shape open lattice grip structures of FIG. 4 were prepared for testing by golfers. Strut width was 1.6 millimeters (mm). Inside and outside sleeve diameters were 2.0 mm. The tubular bodies were prepared from Formlabs RS-F2-LGR-02 flexible resin. (Formlabs, Inc., Somerville, Mass.). The resin was a blend of urethane acrylate oligomer (75-90% by weight), acrylate monomer (25-50% by weight), and urethane acrylate monomer 25-50% by weight). The mixture was formulated by the manufacturer to a cured resin Shore hardness of 80-85 units using ASTM test 2240.

3D printing was carried out using a Formlabs 2 3D printer (Formlabs Inc., Somerville, Mass.).

Testing of Grips

Testing of the grips of the invention was completed by seven people with differing handicap and putting ability. Tester Handicaps ranged from 8 to 35, one novice had no handicap.

Location of testing was the DuPont de Nemours Country Club practice putting green in Wilmington, Del. An Odyssey O-works putter was equipped with a Proformance sports Lattice Structure Grip with a star structure as described above in FIG. 4.

The club was equipped with Tekscan wireless transceivers as described above and the grip was equipped with force sensors with one sensor located under the left hand of the golfer ("top" of the grip) and one sensor located under the right hand of the golfer ("bottom" of the grip). Sensors were inserted into a shallow indentation in the surface of the lattice structure and the overall grip was wrapped with slightly cushioned tennis grip tape.

Putting distances were 6 and 8.2 meters slightly uphill for all testers Five trials were completed by all testers. The distance of each final putt from the hole was also measured.

In addition, putting with an unwrapped (sleeveless) grip at 6 and 8.2 meters were conducted by testers 1 and 4 for force comparison with the wrapped grip.

Tester handicaps were as follows (table 2).

TABLE 2

| Tester Number | Handicap |
|---|---|
| 1 | 8 |
| 2 | 35 |
| 3 | Not tested |
| 4 | (Novice with no handicap) |
| 5 | Not tested |
| 6 | 12 |
| 7 | 20 |
| 8 | 18 |
| 9 | 15 |

Results

There is no a priori reason to assume that gripping force by a golfer should affect the accuracy of a shot, in this case a putt. So long as the selected direction of the putt is accurate, the speed of the ball as it exits the club head is appropriate, and the club head does not deviate from the golfer's selected line, then an accurate putt should result that follows the line that the golfer has chosen.

Surprisingly, the present inventors have discovered that the way that a golfer distributes gripping force between their two hands when putting, as measured by the present invention, can reflect on the precision of a putt and also is a characteristic in general of the handicap and hence the overall quality of the player.

For each golfer, the typical force pattern shown in FIG. 6 was seen. The maximum amount of gripping force applied for each hand was then extracted from the data for each test. Several trials were run and average numbers and standard deviations for each set of trials were calculated. The data taken in this section using lattice grips is very similar in trends and magnitudes to the data taken with conventional grips with sensors on their surface. This observation shows the success of the embedding of sensors in the lattice as a means to collect force data from a grip.

6 Meter Putts

The summary data together with % standard deviations of the force applied by each hand for five of the golfers is shown below in table 3.

TABLE 3

| Tester/ Handicap | Left Hand Average (g) | LH SD* (%) | Right Hand Average (g) | RH SD* (%) |
|---|---|---|---|---|
| 1/8 | 598 | 48.0 | 209 | 38.6 |
| 2/35 | 779 | 31.6 | 752 | 14.3 |
| 7/20 | 1287 | 14 | 552 | 28 |
| 8/18 | 471 | 16 | 270 | 45 |
| 4/none | 452 | 16 | 1141 | 15 |

*SD = Standard Deviation

The distinctive difference between the low handicap 8 golfer and the 35 handicap golfer appears to be in the lighter touch applied by the former overall, and the significantly lower force applied by the right hand, which is the hand used to push the club for right handed players. A similar observation was seen with the novice golfer (tester 4). Tester 4 applied the most force on his right hand among the golfers shown in the table.

These data seem to suggest that for an expert golfer, control of the club can be helped during putting by a relaxed grip rather than a tight or tense grip. Once a suitable grip force is attained, the variance of the grip force does not appear to be a factor that differentiates among any of these three golfers.

The table 4 below shows the standard deviation in distance from the hole achieved by the same group of golfers.

TABLE 4

Distance Variance at 6 meters.

| Tester/Handicap | Standard deviation in distance (cm)* |
|---|---|
| 1/8 | 36 |
| 2/35 | 53 |
| 7/20 | 36 |
| 8/18 | 48 |
| 4/none | 53 |
| 6/12 | 46 |

(* centimeters)

Table 4 above shows the handicap vs. distance variability (in centimeters) at 6 meters for the golfers with a handicap and for the novice. The lowest handicap golfer has the lowest variability at 36 cm. Between an 8 and a 20 handicap, the standard deviation only varies between about 36 and 48 cm. The non-handicapped golfer and the 35 handicap golfer had a variability of 53 cm. As consistency of distance is a key element of a successful golfer's game, the present inventors believe that their invention provides important data on the swing employed by a golfer to make consistent shots on the tee box, on the fairway, in hazards, in the rough, as well as on the green. In this case, support of the club with the left hand (for a right handed golfer) contributes to stability of the putt and may also be determinative of a good putt. That level of support can be measured by the present invention.

Two of the intermediate handicap golfers did use a strong grip on their right hands. One tester (tester 9, 15 handicap) showed an unusually high grip strength in the right hand of over 3000 grams and a left hand force of less than 400 g. Tester 6 (12 handicap) also used higher force on the left hand (305 g left hand and 1140 right hand on average) than the right hand. The following table shows the standard deviations in distance obtained for testers 6 and 9.

TABLE 5

| Tester/Handicap | Standard deviation in distance (cm) |
|---|---|
| 6/12 | 46 |
| 9/15 | 27 |

Factors other than grip force will also contribute to putt accuracy. The less experienced golfers can be expected to select a less effective line especially when the green has surface curvature. Here, an attempt was made to select out that variable by using a green that was a flat plane with only a slight uphill gradient. The line selected by all golfers would be expected to be a straight line to the hole and therefore consistent applied speed of the ball would be the major determinant of distance consistency.

Handicap also is a function of many aspects of golf play. Although a low handicap player may be expected to have a low distance variability in putting, the expectation should be tempered by the fact that putting is only one aspect of a golfer's handicap number. However the application of force, but not too much force, to the left hand (for a right handed golfer) appears to be a characteristic of a competent putter.

8.2 Meter Putts

Adding 2 meters to the putt length introduces an increase in the element of mental stress into a golfer's results. However, trends in the force applied to the right and left hand sensors were similar to those at 6 meters. Testers 1 and 8 used much lower force on their right hands relative to left and compared to the other testers. The table 6 below shows the forces applied at 8.2 meters.

TABLE 6

| Tester/Handicap | Left Hand Average (g) | Right Hand Average (g) |
|---|---|---|
| 1/8 | 600 | 150 |
| 2/35 | 810 | 1550 |
| 7/20 | 1220 | 1250 |
| 8/18 | 460 | 100 |
| 4/none | 375 | 1550 |
| 9/15 | 550 | 3100 |
| 6/12 | 1000 | 2750 |

Once again, tester 9 applied a very high force with his right hand. Tester 6 also applied a high force with his right hand, higher than for the 6 meter putt. There seem to be two successful strategies for a golfer to remain in the population of "golfers that putt like handicapped golfers". One is to keep a light touch on the grip and apply more force to the left hand than the right hand. The other is to grip the right hand strongly. Both strategies can result in a stable putt. The large variance in distance achieved by the novice golfer can be explained in part his failure to use an effective strategy for gripping the putter.

Table 7 shows the handicap vs. distance standard deviation for the 8.2 meter puts. The two lowest handicapped players had variabilities of 63.5 cm. The 20 handicapped player had a variability of 43 cm.

TABLE 7

Distance Variance at 8.2 meters.

| Tester/Handicap | Standard deviation in distance (cm) |
|---|---|
| 1/8 | 63.5 |
| 2/35 | 53 |
| 7/20 | 43 |
| 8/18 | 51 |
| 4/none | 112 |
| 6/12 | 63.5 |
| 9/15 | 51 |

The novice player here continued to have a relatively large variability that was higher than for the 6 meter putt. He also gripped harder with his right hand than the left.

It is desirable for a golfer to place the ball as close as possible to the hole, preferably inside it, but also to place the ball consistently over multiple shots. For the set of golfers tested here, each golfer with the exception of the novice shot a range of approximately zero to 76 or less cm. One other exception was tester 6 (handicap 12) who hit one ball 137 cm from the hole.

A reasonable conclusion from these data is that each of the handicapped golfers putted on average the statistically similar distances during these tests and that the measurements from all the handicapped golfers fell into the same population. Means and standard deviations of the sets of data (five measurements per tester for each of 6 meters and 8.2 meters) for the novice golfer and the remaining six golfers are given below in table 8.

TABLE 8

| Golfer set | distance (meters) | mean (cm) | SD (cm) |
|---|---|---|---|
| Novice | 6 | 81 | 53 |
| Handicapped | 6 | 38 | 33 |
| Novice | 8.2 | 216 | 112 |
| Handicapped | 8.2 | 52 | 43 |

The novice golfer clearly shows a mean and standard deviation performance that needs improvement and put him on the edge of the average performance of the other golfers. A two-sided t test on the data show that with a null hypothesis that all golfers (including the novice golfer) are equivalent, the p value, which is the calculated probability of finding these observed results when the null hypothesis is true are 16% at 6 meters and 6% at 8.2 meters. In other words, at 8.2 meters there is only a 6% chance of the novice golfer being in the same class as the average handicapped golfer. In comparison, the corresponding values for tester 6 compared to the other handicapped golfers are 25% and 61% respectively.

An f test compares the variances of two samples and presents them as a ratio. The f test result for 6 meters is 0.126 and for 8.2 meters is 0.003, with the handicapped golfers having the lower variance. Attention to grip force and selection of a strategy for gripping may improve these numbers for the novice golfer.

Testing with Unwrapped Grid

Testers 1 and 4 were tested with unwrapped grips. For tester 1 the pattern remained that more force was applied by the left hand than the right. The force measured from the left hand was higher at 6 meters (670 g) on the unwrapped grip than the wrapped grip (400 g) so some attenuation was experienced in the presence of wrapping. The left hand force at 8.2 meters was the same in both wrapped and unwrapped grips (600 g).

For tester 4 all of the measurements were similar for wrapped and unwrapped grips.

The grip and method of instrumentation described and claimed here are not to be limited to the examples shown for golf putters and any sport or activity that requires gripping a handle or other form of grip can make use of the invention described here. As non-limiting examples these activities include other types of golf club, baseball, cricket, tennis, badminton, any other racket sports, steering an automobile or any manual powered vehicle or aircraft.

We claim:

1. A method of controlling the feel of a grip assembly comprising the steps of;

(a) providing a grip assembly for an item of sporting equipment, said grip assembly comprising an elongated tubular body having a long axis running from a first end to a second end that is distal to the first end, said tubular body comprising;

an inner wall that extends from the first end to the second end along the long axis, said inner wall having an outer surface and an inner surface, said outer surface forming a hollow interior of the assembly, said hollow interior having a cross section through which a shaft of the item of sporting equipment can pass, an open lattice structure that is located adjacent to the inner surface of said inner wall in a region between the first end and the second end, an outer wall that extends from the first end to the second end along the long axis having an inner and outer surface relative to the open lattice structure, the outer surface of the outer wall forming an outer surface of the tubular body extending between said first end and said second end and the inner surface of the outer wall facing the open lattice structure over at least a portion of the inner surface, wherein the open lattice structure is located between the inner wall and the outer wall;

(b) adjusting the structure of the open lattice structure by adjusting parameters selected from the group consisting of the material of construction of the open lattice structure, the Shore hardness of the material of construction of the open lattice structure, the detail of the structure of the open lattice structure, and any combination of the foregoing.

* * * * *